US005096553A

United States Patent [19]

Ross et al.

[11] Patent Number: 5,096,553

[45] Date of Patent: Mar. 17, 1992

[54] TREATMENT OF RAW ANIMAL HIDES AND SKINS

[75] Inventors: Graeme D. Ross; Arnold S. Herer, both of Fredericton, Canada

[73] Assignee: Ionizing Energy Company of Canada Limited, Fredericton, Canada

[21] Appl. No.: 480,339

[22] Filed: Feb. 13, 1990

Related U.S. Application Data

[63] Continuation of Ser. No. 246,969, Sep. 21, 1988, abandoned, which is a continuation of Ser. No. 924,333, Oct. 29, 1986, abandoned.

[30] Foreign Application Priority Data

Sep. 11, 1986 [CA] Canada ..... 518013

[51] Int. Cl.[5] ..... C14C 5/00

[52] U.S. Cl. ..... 204/157.15; 204/135; 422/22; 422/28; 8/94.1 R; 8/94.15

[58] Field of Search ..... 204/157.15, 135; 422/22, 28; 8/94.1 R, 94.15

[56] References Cited

U.S. PATENT DOCUMENTS

| | | | |
|---|---|---|---|
| 3,779,706 | 12/1973 | Nablo | 21/51 R |
| 3,911,281 | 10/1975 | Ihme | 250/492 A |
| 4,305,000 | 12/1981 | Cheever | 250/492.3 |
| 4,438,570 | 3/1984 | Dokoupil | 34/1 |
| 4,935,031 | 6/1990 | Münch et al. | 8/94.18 |

FOREIGN PATENT DOCUMENTS

| | | | |
|---|---|---|---|
| 152651 | 7/1912 | Canada | 204/157.15 |
| 360903 | 10/1936 | Canada | 204/157.15 |
| 499331 | 1/1954 | Canada . | |
| 561924 | 8/1958 | Canada . | |
| 605021 | 9/1960 | Canada . | |
| 708165 | 4/1965 | Canada . | |
| 717935 | 9/1965 | Canada . | |
| 816653 | 7/1969 | Canada | 204/157.15 |

OTHER PUBLICATIONS

Synergistic Effects in the Short-Term Preservation of Hides with Antiseptics and Gamma Radiation, T. A. Du Plessis et al., Radiat. Phys. Chem. vol. 22, No. 3.5, pp. 491-502, 1983.

Electron Beam Irradiation of Crust Leather, Fresh Hides and Green Salted Hides, Effect of Preservation and Physical Properties, D. G. Bailey and M. J. Haas.

Gamma Irradiation: The Preservation of Hides and Skins and the Sterilisation of Imported Dry and Dry-salted Goatskins, M. Dempsey et al.

Radiation Curing and Other Hide Preservation Techniques, D. G. Bailey, The Leather Manufacturer, Sep. 1985, p. 25.

*Primary Examiner*—T. Tung

*Assistant Examiner*—David G. Ryser

*Attorney, Agent, or Firm*—Fleit, Jacobson, Cohn, Price, Holman & Stern

[57] ABSTRACT

There is described a new and improved method of treating raw animal hides and skins prior to tanning, wherein the hides and skins are initially washed, trimmed, fleshed and demanured, including the steps of dipping the hides and skins in a dilute antiseptic solution for a predetermined amount of time, removing excess moisture from the hides and skins following dipping, and irradiating the hides and skins with substantially monodirectional electron beams to expose each hide and skin to a dose adjustable within the range of 0.75 to 4.0 Mrads at a dose rate adjustable within the range of $10^5$ to $10^7$ rads/sec.

21 Claims, 2 Drawing Sheets

TREATMENT OF RAW ANIMAL HIDES AND SKINS

This application is a continuation of application Ser. No. 07/246,969, filed Sept. 21, 1988, which is a continuation of prior application Ser. No. 06/924,333, filed on Oct. 29, 1986, now abandoned.

BACKGROUND OF THE INVENTION

The present invention relates to a method of preserving certain raw materials prior to the secondary treatment of such materials to form a stable and therefore more usable end product. More specifically, the invention relates to a method of treating organic material, such as raw animal hides and skins, wherein the material is exposed to a combination of dilute antiseptic, and electron beam irradiation, to temporarily preserve the material prior to further treatment which stabilizes the skins and hides for end product use.

There is a need to introduce a new method to cure and preserve green hides and skins that can alleviate the hide industry's pressing problems of environmental pollution, transport container damage and increasing material and labour costs. Current methods for curing and preserving hides and skins, collectively referred to hereinafter as hides, use different chemicals, principally salt (NaCl), that are becoming increasingly difficult to dispose of in safe, economic and environmentally acceptable ways.

Hides flayed from slaughtered animals are delivered in bulk to a processing facility on or off the abattoir premises. The sequence of steps in the processing of the hides may vary from facility to facility, but generally speaking, the hides are initially soak washed, and trimmed. Washing removes soil, cools and softens the hides, and, assuming the use of recirculated cool water, the resulting depressed temperatures slow bacterial growth. The hides are trimmed to remove remaining extremities including the ears, tail, metal rings and larger pieces of flesh. The hides are conveyed via the trimmer from the washer to a demanuring and fleshing machine which removes unwanted flesh from one side of the hide, and manure from the other. The hides are then weighed and graded according to animal type and prefleshing quality, and records of the grading are kept. The hides are then cured. Conventional curing in the industry today most often involves the brine curing of the hides using either of the raceway or vat cure methods of brine curing commonly in use. The hides are soaked in a concentrated salt solution for up to 20 hours during all or part of which time they may be agitated. The brine cured hides are removed from the vats or raceways, and are then folded, stacked and palletized for medium to long term storage prior to tanning. Additional salt is sometimes simply poured onto each hide prior to folding for additional preservation. The cured hides are purchased by tanners who convert them into the stable end product universally known as leather.

A significant problem of the hide and skin industry today revolves around the intensive use of salt and brine. Curing itself is relatively inexpensive, but the ensuing salt disposal problems are becoming so significant as to threaten the closure of the domestic industry. Salt is used for its osmotic characteristics on cells which force water out of the cells of bacterial and animal flesh, thereby inactivating the aqueous intracellular medium needed for the unwanted decay of the hides. Once rehydrated, hides cured in this manner are prone to rapid decay.

Disposal of the salt, usually common sodium chloride, is becoming increasingly difficult and expensive due to increasingly stringent pollution limits. Salt is a problem not only to the processor, who must dispose of up to 2 gallons of brine per hide (3,000 to 14,000 gallons per day), but also the tanner who may have to wash out similar amounts of salt.

Problems of uneven salt distribution to the hides exist, and burns, stains and pitting due to salt are not uncommon. Downstream tanning costs are increased due to the extended times required to rehydrate the hides and remove the salt, and the unevenness of the process may require expensive handling variations sometimes on an individual hide basis. A salt or brine cured hide will yield up to 3% less product than a green hide. Salt curing often requires a cationic detergent prewash of the hides to increase the susceptibility of the hides to brine permeability. The detergents themselves may be environmentally harmful and costly to dispose of. Brine curing often requires the addition of chlorinated phenols following the cure to extend preservation, and such phenols are deadly to aquatic plant and animal life.

Other alternatives to salt curing include the use of biocidal antiseptics, refrigeration and sulfite preservation. However, environmentally acceptable concentrations of biocides alone cannot preserve a hide on average for more than 5 days. Refrigeration is much too expensive to be practical even on a large scale basis, and sulfites are coming under increasing regulatory control.

Radiation treatment has been investigated as a means for short to medium term hide preservation. In an unpublished paper presented at the American Leather Chemists Association in June, 1984, D. G. Bailey and M. J. Haas reported on the results of their investigations into the use of electron beam radiation to sterilize and preserve fresh hides. Bailey found that through singular use of electron beam radiation, the dose levels required to attain sterility are close to, and sometimes exceed, the tolerance dose that will cause damage to the hide and subsequent hide products. Other researchers, including T. A. Du Plessis et al., have reported on the results of similar experimentation using gamma radiation (Radiat. Phys. Chem. Vol. 22, No. 3.5, pp 491-501, 1983).

Du Plessis's work investigated the use of gamma radiation in combination with an antiseptic pretreatment of the hides. For various reasons, not the least of which includes the relatively unattractive economics of cobalt as a radiation source for the treatment of laminar products such as animal hides, and the inability to effectively control dose rates from natural isotope sources, such research has not yet resulted in the proposal of an acceptable alternative to traditional brine curing.

SUMMARY OF THE INVENTION

It is an object of the present invention to provide an improved method for treating raw hides which obviates and mitigates from the disadvantages of previous methods.

It is a further object of the present invention to provide a novel means of treating raw hides using high energy electron beam radiation administered at selected doses and dose rates determined with reference to hide type and characteristics, said irradiation applied in combination with a dilute antiseptic pretreatment.

According to the present invention then, there is provided a method of treating raw animal hides and skins prior to tanning, wherein the hides and skins are initially washed, trimmed, fleshed and demanured, comprising the steps of, a) dipping the hides and skins in a dilute antiseptic solution for a predetermined amount of time, b) removing excess moisture from the hides and skins following the dipping, and c) irradiating the partially dried hides and skins with substantially monodirectional electron beams to expose each such hide and skin to a dose adjustable within the range of 0.75 to 4.0 Mrads at a dose rate adjustable within the range of $10^5$ to $10^7$ rads/sec.

BRIEF DESCRIPTION OF THE DRAWINGS

Embodiments of the present invention will now be described in greater detail and will be better understood when read in conjunction with the following drawings in which.

DESCRIPTION OF THE PREFERRED EMBODIMENTS

Accelerated electrons emerging from an electron beam generator possess substantial kinetic energy capable of performing useful work on organic material, including raw hides and skins. The type and amount of work done by fast electrons depends upon the composition of the material being irradiated, system geometry and the dose of radiation received by the product. Dosage is governed by beam current (the rate at which electrons strike the product) and the duration of product exposure to the beam. Dosage is also governed by 1) the corpuscular energy of the beam at product level (MeV) and 2) the effective electron density of the irradiated product. In this application, "dose" (or "absorbed dose", which may be used synonymously) measured in rads, means the amount of energy, (ergs), absorbed per unit mass of irradiated matter at a point in the region of interest.

As will be appreciated by those skilled in the art, the direct action of ionizing radiation is to hit and disrupt molecular components of the irradiated material. Many of the microbials responsible for decay exist as large biopolymers and are therefore preferentially targeted for selective degradation. Accordingly, biocidal effects should outstrip deleterious effects on other inanimate, organic substances. The "indirect" action of irradiation is to produce free radicals which can migrate to reach and interact with other cells and cellular components, disrupting such cells by so doing. This effect is not however as selective as the direct action, and can result, unless controlled, in significant disruptions of desirable tissue to cause a loss of product integrity and other deleterious effects on strength, colour, elasticity and so forth. It is important therefore to encourage recombination of fractured molecules, usually consisting of activated water, and this is facilitated in part by increasing the dose rate. Furthermore, the biological effect of a given dose has been disclosed by research and experience to increase to a limit as a function of increased dose rate, which permits less time for repair of sublethal damage occurring during the exposure, and less repopulation resulting from cell division. Higher dose rates are therefore believed preferable for utilization in the present process and this factor favours the use of machine-driven electron beam generators whose output may be varied, to increase dose rates to a level literally many thousands of times higher than that available from gamma sterilizers. Moreover, the increased dose rates possible with electron beam generators permit higher irradiation speeds conducive to the large throughputs of laminar feed stock necessary for the economic processing of hides.

Figure 1:
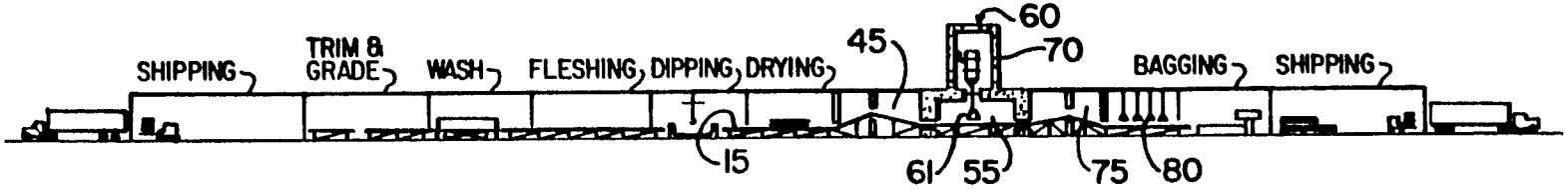
FIG. 1 is a linear schematic of the present process from the delivery of raw hides, to the treatment and bagging thereof for shipment.
Figure 2:
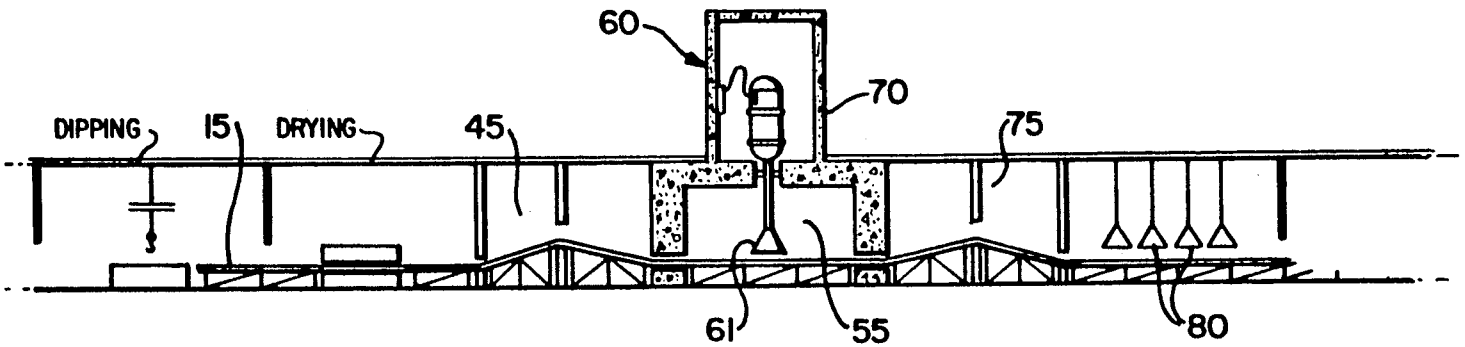
FIG. 2 is an enlarged view of a portion of FIG. 1 showing the dipping and irradiation of the hides.

With reference now to FIG. 1, which shows a schematical linear presentation of the present process, the washing, trimming, fleshing, demanuring and grading steps are substantially the same and are performed in substantially the same manner as in conventional facilities and need not therefore be described in further detail herein other than as follows hereinafter.

Following fleshing, the hides are dipped in an antiseptic solution. The applicants have performed tests using Busan 52 TM (Buckman Laboratories), Proxel GXL TM (IEI Americas) Sterizol TM (Birko Chemicals) and a mixture of a sulfite and acetic acid, and have discerned little difference in the relative effectiveness of any of these chemicals when used in conjunction with the upper range of radiation doses. Other available antiseptics include Busan 72 TM, Merpin TKE TM, Vantoc CL TM, Vantocil 10 TM, Nerclan GLO TM, Formalin TM and Kanthon LP TM which, although not yet tested, may also produce satisfactory reductions in superficial bacterial loads, and prevent excessive repopulation between dipping and pre and/or post irradiation bagging of the hides. Concentrations of antiseptics used are variable generally within the range 50 to 1000 ppm, depending upon the antiseptic used. The following concentrations were tested in two separate early trials:

Trial No. 1

Busan 52: 50 100 150 PPM with standard amounts of Triton 101 used a surfactant (100% float)

Sterizol: 12 25 125 PPM with surfactant (100% float)

Proxel: 100 500 1000 PPM with surfactant (100% float)

Trial No. 2

Busan 52: 50 100 500 PPM, surfactant, (100% float)

Proxel: 500 1000 PPM, surfactant, (100% float)

Sulfite/acetic acid, 20% float, 0.5% and 0.25% sulfite/acetic acid by weight of hides, 5% acetic acid solution.

Subsequent trials have indicated the greater effectiveness of Busan 52 at lower radiation doses particularly in the 0.8 to 1.0 Mrad range.

Using the present combined antiseptic dip/irradiation process, satisfactory results have been obtained with antiseptic concentrations substantially lower than those recommended by the manufacturers for short term preservation use, and much lower than those used in practice on the order of 1/10 to 3/4 the usual levels. The test results indicate that the use of even lower concentrations may be possible.

The hides are dipped for an average of 20 minutes within the range of 5 to 45 minutes, which in some circumstances might be expanded to 1 minute at the lower end and 60 minutes at the upper end, depending upon concentrations used, and the type and characteristics of the hide including its size, thickness and condition. The hides are preferably agitated while soaking in the antiseptic.

Regardless of concentrations used, the use of antiseptic alone will preserve the hides for no more than 5 days on average, beyond which the resulting putrefaction will seriously diminish the utility of the hides for quality leather production. As will be appreciated, the disinfectant is primarily effective against superficial infestations and has no substantial effect on other decay mechanisms including enzyme induced autolytic decay. Following dipping, the hides are placed on a conveyor 15 for transport to a dryer for the removal of excess moisture from the hides. Less water on the hides maximizes the desired dose-effect relationship. A by-product of electron beam radiation is heat which vaporizes residual moisture in the hides that is best isolated from the scan horn window of the electron beam generator to prevent potential damage, and this is a further justification for the drying step. The hides may be squeeze-dried, and the expelled moisture can be processed for antiseptic recovery and recirculation. At this stage, a biological assay may be performed on the hides, if desired, for quality assurance purposes, and to monitor on an on-going basis the continuing effectiveness of the antiseptic. Cooling of the hides may also be performed at this stage prior to irradiation to suppress repopulation and to minimize subsequent temperature elevation from irradiation. It is emphasized however that neither the biological assay nor the intermediate cooling is considered an essential part of the present process, nor should they be considered as such.

Following drying, the hides may be wrapped or bagged in a thin film (not shown) and then enter a vertical (or horizontal) maze 45 the function of which is to act as a physical barrier to radiation leaking from irradiation chamber 55. The use of mazes of this sort is known to electron beam users and need not therefore be described in further detail herein.

The electron beam installation 60 itself is fairly standard and includes, for example, a parallel-fed, gas insulated cascade circuit system accelerator which propels the electron beams through a scan horn or cone 61 into a fanned-shaped electron flux used to irradiate the products passing thereunder. The generator itself requires little or no modification for use in connection with the present process apart from a widened cone necessary to irradiate the entire width of the hides passing thereunder.

The generator is supported in the usual concrete containment structure 70 having thickened walls and ceilings for full shielding of plant personnel. Special adaptations to structure 70 may include means (not shown) to provide a moisture shield between the conveyor and the cone and a humidity exchanger to remove ambient moisture released from the hides due to the heat of radiation. The conveyor itself may be modified to include suitable means, such as clips or rollers, to maintain the hides in a substantially flat condition for uniform irradiation.

The actual doses and dose rates will vary depending upon the animal type and the characteristics of the hide, including its size, thickness, moisture content and so forth. Generally speaking, effective treatment will vary with surface doses adjustable within the range of 0.75 to 4.0 Mrads although doses towards the upper limit of this range could have undesirable effects causing damage to the hides, including significant loss of tensile strength in the finished leather. Testing has disclosed that in the dose range between 0.75 and 3.2 Mrads, and particularly single-sided irradiation between 1.6 and 3.2 Mrads, and two-sided irradiation between 0.8 and 2.8 Mrads per side, satisfactory survival rates are readily obtained without significant apparent diminution of the hides. Dose rates will vary in practice, but will be adjustable substantially within the range of 0.1 to 10 million rads per second.

A further variable will be the speed at which the hides are conveyed through the electron beam. This will depend upon the desired dose and may be adjusted empirically in accordance with manufacturer's specifications and user's calibrations. To achieve the desired doses within the ranges specified above, conveyor speeds on the order of approximately 20 to 120 linear feet per minute are contemplated.

The energy of the electron beam is fixed by the voltage setting of the generator itself. The greater the energy of the electron beam, the greater, of course, will be its penetrating power. On the other hand, capital costs escalate rapidly with increasing voltage making it important for obvious economic reasons to balance energy versus cost. It is contemplated that generators in the 2 to 5 MeV range will suffice, but 3 MeV machines are preferred to provide the necessary penetration over the anticipated range of hide thicknesses at an acceptable cost. Voltage much below this level would likely necessitate two-sided exposures.

The hides may be turned over for two-sided irradiation or exit the irradiator/flipper complex 114 (FIG. 3) in the case of single-sided irradiation.

An exit maze 75 is provided downstream of the generator through which the irradiated hides pass following treatment. Again, as will be readily understood, the maze serves a shielding function well understood in the art.

Preferably, and particularly if the hides have not been pre-bagged, the irradiated hides may be dried once again to enhance storage properties. Use of, for example, ultraviolet lighting 80 at this stage is also contemplated to prevent or at least reduce the risk of recontamination. To the extent possible, all downstream facilities below the generator including the packaging operations, should be "clean room" sterile to prevent recontamination of the hides even if they are pre-bagged. Unbagged hides are drop-bagged and are then boxed for transport. If necessary, a suitable sterile antiseptic may be applied or sprayed onto the unbagged hides just prior to bagging to further reduce the risks of recontamination and improve storage longevity. Bagged hides are boxed for transport. The outer packaging may be done in groups of rolled hides.

Figure 3:
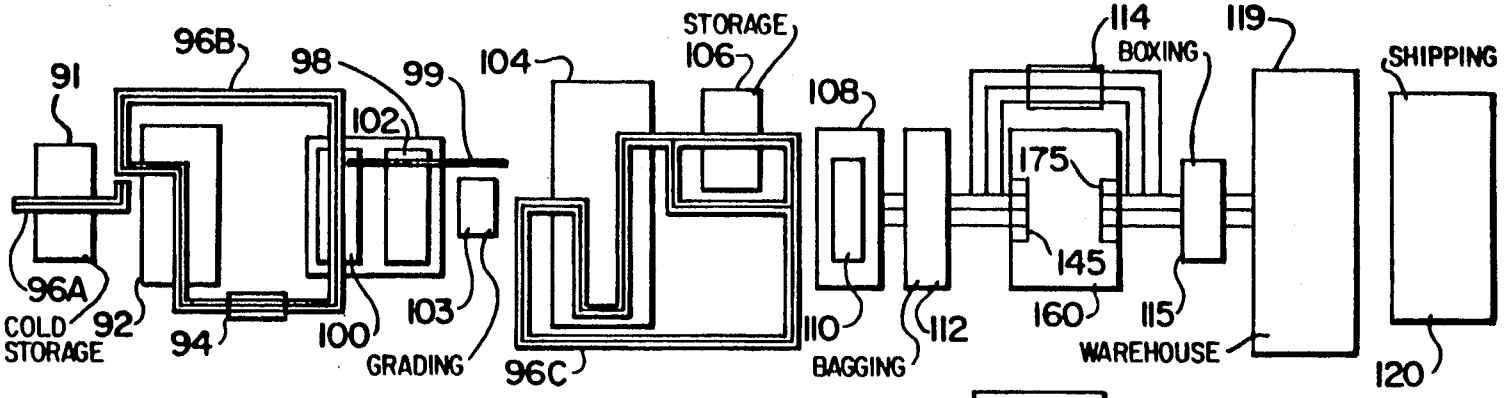
FIG. 3 is a linear representation, in plan, of a modified process for the delivery of raw hides, to the bagging and treatment thereof prior to shipping.
Figure 4:
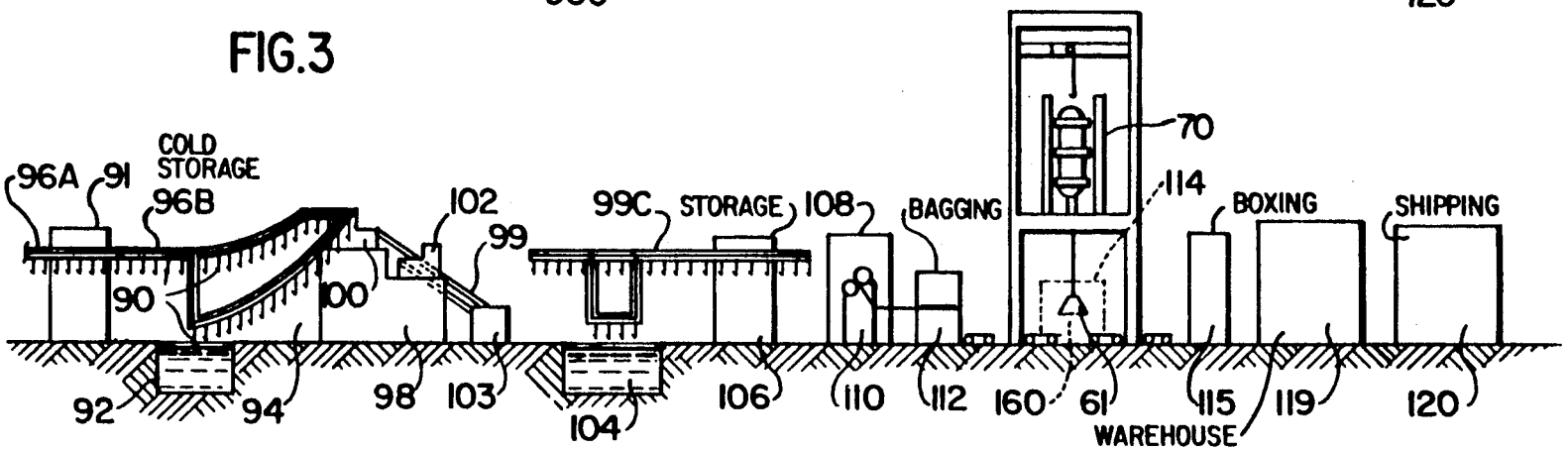
FIG. 4 is an elevational view of the process shown in FIG. 3.

With reference to FIGS. 3 and 4, there will now be described a modification of the present process, intended to maximize the treatment of hides, and allow the tracking of individual hides from delivery from the packing house to shipment to the tanner.

Hides flayed at the packing plant are hung on an individually numbered and bar coded hook 90 to provide specific hide identification. Except when removed from the hide prior to fleshing, the hook will remain attached until the hide is dried and bagged prior to irradiation.

Hides received from the packers at the processing facility are suspended by means of hooks 90 from an overhead conveyor 96A. If not treated immediately, the hides may be placed in cold storage 91 while still suspended from their respective hooks 90, and may even be chill blasted prior to cold storage. From the reception area, the hides are delivered by means of conveyor 96B to a wash area consisting of a fresh water bath 92 through which the hides are drag-washed for a period of approximately ten minutes, depending upon their condition. The hides are then lifted from the drag-wash, past a pre-trim station 94 where extremities, metal rings, and so forth are removed, and delivered by overhead conveyor 96B to a fleshing area 98 for the removal of remaining flesh and manure.

Fleshing area 98 may include two separate fleshing machines 100 and 102 used in series or in parallel (not shown). Prior to fleshing, hooks 90 are removed from the hides, and conveyor 96B returns to the receiving area in completion of its closed loop. Each hook 90 is dropped to the bottom of either the first or second fleshing machine via hook chute 99, depending upon whether the hide passes through either or both apparatus, and is reattached to its respective hide prior to suspension from a second closed loop overhead conveyor 96C.

Once fleshed, the hides are dropped via a chute to a grading station 103 where they are trimmed and graded. Each hide is then reattached to its bar coded hook. Once rehooked the hides are ready for curing and conveyor 96C drags the hides through the dilute antiseptic dip 104 for treatment lasting anywhere from as little as one minute to as many as sixty minutes. As aforesaid, treatment times will vary depending upon concentrations of antiseptic used, and the type and characteristics of the hides themselves. The dipped hides are delivered by overhead conveyor 96C either to a refrigerated storage area 106, or directly to drying station 108. Storage area 106 will receive the hides in the event of a developing backlog, or if other hides are to be irradiated out of sequence.

Hooks 90 are dropped from overhead conveyor 96C at drying station 108 and the conveyor returns to the fleshing area. An effective means of drying the hides is to pass them through a wringer 110, or through two or more such wringers arranged in series. Hooks 90 are removed prior to wringing, and go separately for cleaning prior to being returned to the packers for attachment to a new hide. Following drying, the hides are individually bagged or wrapped as shown schematically at station 112, and the packages are identified using the same number as that appearing on respective hook 90, with such additional coding being added, including the date and badge number, as may be required.

Although a conveyor belt may be used to carry the bagged hides through the entry maze 145 and e-beam vault 160, a problem may develop particularly in the use of vertical mazes if the slope thereof is such as to cause the hides to slip due to gravity and bunch up in the ends of their respective packages. Advantageously therefore other types of conveying means may be adopted such as the use of carts (not shown) which travel horizontally through a maze wherein the movement of the cart is substantially entirely in the horizontal plane, or chair-lift type conveyors (also not shown) with each chair including a sizable seat (such as 8 feet×5 feet) pivotally suspended from the conveyor loop so that the seat remains horizontal although the chair itself moves up and down through a vertical maze. Whichever conveyor system is used will or should include buffered zones to compensate for the differences between the delivery speeds from the drying station, and the time required for a single or double pass through e-beam vault 160.

Following the first pass of the hides through vault 160 and exit maze 175, the packaged hides are flipped over at flipping station 114 and returned to the vault to complete a two-sided exposure, if required. Each time the package emerges from the vault, a sticker or marker may be affixed to the upper exposed surface of the bag to confirm irradiation of that side. Following either single or double-sided exposure of the hides, the individually wrapped and treated hides may then be conveniently boxed in lots of approximately 30 per box in boxing station 115. Obviously, there is nothing critical in the choice of 30 hides per box but this is a relatively convenient quantity for subsequent handling and shipping purposes. The "boxed" hides are either stored in warehouse 119 or delivered immediately to "shipping" 120 for delivery to the tanner.

It is apparent from tests performed by the applicants that the combination of antiseptic dip/radiation is synergistic in effect, although the reasons for this are not fully understood. It has been observed that over the range of antiseptic concentrations used, in the absence of irradiation post treatment, hides sealed in air-tight bags did not keep for more than 5 days on average, after which the hide became putrefied to the point of nonusefulness. Hides treated with radiation alone for doses up to 2.5 Mrads experienced similar deterioration within the same approximate period of 5 to 7 days, although somewhat longer preservations were noted for stand-alone radiation treatments at higher doses.

In contrast, hides treated initially with dilute antiseptic followed by optimum electron beam radiation, retained all of the desired properties for at least sixty-eight days. On-going testing suggests that these preservation characteristics can be extended beyond this sixty-eight day period, possibly for as long as one year.

While the invention has been described in connection with its important application to the treatment of hides and skins, features of the present process may be used in other applications where similar advantages are desired, and the novel aspect of the process, and of the apparatus may also be used elsewhere as desired. Further modifications occurring to those skilled in the art are deemed to fall within the spirit and scope of the invention as defined in the appended claims.

We claim:

1. A method of treating raw animal hides and skins prior to tanning, wherein the hides and skins are initially washed, trimmed, fleshed and demanured, comprising the steps of:

a) dipping said hides and skins in a dilute antiseptic solution for a predetermined amount of time;

b) removing excess moisture from said hides and skins following said dipping; and c) irradiating said partially dried hides and skins with substantially nondirectional electron beams to expose each such hide and skin to a dose adjustable within the range of 0.75 to 4.0 Mrads at a dose rate adjustable within the range of $10^5$ to $10^7$ rads/sec.

2. The method of claim 1 wherein the duration of said dipping is within the range of 1 to 60 minutes depending upon the nature and characteristics of the dipped skins and hides.

3. The method of claim 1 wherein said skins and hides are conveyed individually through a flux of said electron beams at a linear speed adjustable within the range of 20 to 120 linear feet per minute.

4. The method of claim 1 wherein the said dose is adjustable within the range substantially between 1.6 and 3.2 Mrads.

5. The method of claim 1 wherein the concentration of antiseptic is variable within the range 50 to 1000 PPM, Depending upon the antiseptic used.

6. The method of claim 1 wherein the energy of said electron beam radiation is within the range of 2 to 5 MeV.

7. The method of claim 1 including the additional step of partially drying the skins and hides a second time following said irradiation thereof.

8. The method of claim 7 wherein said skins and hides are retreated with antiseptic following irradiation thereof.

9. The method of claim 1 including the additional step of packaging said treated skins and hides under substantially antiseptic conditions to improve preservation times.

10. The method of claim 1 wherein said partially dried skins and hides are individually pre-bagged prior to being irradiated.

11. An industrial scale method of preserving a plurality of raw hides and skins prior to an additional treatment thereof to produce leather and related stable products, comprising the steps of:

a) washing, trimming, fleshing and demanuring said raw hides and skins;
b) dipping said hides and skins in dilute antiseptic;
c) partially drying said hides and skins to remove excess moisture therefrom;
d) individually pre-packaging said partially dried hides and skins;
e) arranging said pre-packaged hides and skins in an extended, substantially flat condition on conveyor means;
f) moving said hides and skins through a flux of high energy electron beam radiation to irradiate one side of said hides and skins at a dose adjustable within the range of 0.8 to 2.8 Mrads and at a dose rate adjustable within the range of $10^5$ to $10^7$ rads/sec.; and
g) irradiating the side of said hides and skins opposite to said one side thereof at a dose adjustable within the range of 0.8 to 2.8 Mrads at a dose rate adjustable within the range of $10^5$ to $10^7$ rads/sec.

12. The method of claim 11 wherein said skins and hides are bathed in said dilute antiseptic dip for a period of between 1 to 60 minutes.

13. The method of claim 12 wherein the energy of said electron beam is within the range of 2 MeV to 5 MeV.

14. The method of claim 13 wherein said skins and hides are conveyed individually through a flux of said electron beams at a linear speed adjustable within the range of 20 to 120 linear feet per minute.

15. A method of treating raw animal hides and skins prior to tanning, wherein the hides and skins are initially washed, trimmed, fleshed and demanured, comprising the steps of:

a) dipping said hides and skins in a dilute antiseptic solution for a period of between 1 and 60 ll minutes;
b) removing excess moisture from said hides and skins following said dipping;
c) arranging said hides and skins in an unfolded subtantially flat condition on conveyor means;
d) moving said hides and skins through a flus of high energy electron beam radiation to irradiate one said of said hides and skins at a dose adjustable within the range of 0.8 to 2.8 Mrads at a dose rate adjustable within the range of $10^5$ to $10^7$ rads/sec; and
e) irradiating the side of said hides and skins opposite to said one side thereof at a dose adjustable within the range of 0.8 to 2.8 Mrads at a dose rate adjustable within the range of $10^5$ to $10^7$ rads/sec.

16. The method of claim 1 wherein the energy of said electron beam is within the range of 2 MeV to 5 MeV.

17. The method of claim 16 wherein said hides and skins are packaged prior to being irradiated.

18. The method of claim 17 wherein said hides and skins are conveyed individually through said flux of electron beams at a linear speed adjustable within the range of 20 to 120 linear feet per minute.

19. The method of claim 18 wherein the concentration of antiseptic is variable within the range of 50 to 1,000 PPM depending upon the antiseptic used.

20. The method of claim 19 wherein said irradiated hides and skins are dried a second time following irradiation.

21. The method of claim 20 wherein said skins and hides are retreated with antiseptic following irradiation thereof.

* * * * *